United States Patent [19]

Kato

[11] 4,430,124

[45] Feb. 7, 1984

[54] VACUUM TYPE BREAKER CONTACT MATERIAL OF COPPER INFILTRATED TUNGSTEN

[75] Inventor: Masaru Kato, Amagasaki, Japan

[73] Assignee: Mitsubishi Denki Kabushiki Kaisha, Tokyo, Japan

[21] Appl. No.: 360,572

[22] Filed: Mar. 22, 1982

Related U.S. Application Data

[63] Continuation of Ser. No. 98,198, Nov. 27, 1979, abandoned.

[30] Foreign Application Priority Data

Dec. 6, 1978 [JP] Japan ..... 53-153381

[51] Int. Cl.[3] ..... H01H 1/02; B22F 3/26

[52] U.S. Cl. ..... 75/248; 200/264; 200/265; 428/569; 428/567

[58] Field of Search ..... 200/206, 264, 265; 75/238, 248; 428/569, 567

[56] References Cited

U.S. PATENT DOCUMENTS

| | | | |
|---|---|---|---|
| 3,449,120 | 6/1969 | Zdanuk et al. | 75/238 X |
| 3,929,424 | 12/1975 | Krock et al. | 75/200 X |
| 4,162,160 | 7/1979 | Witter | 200/266 X |
| 4,299,889 | 11/1981 | Kato et al. | 75/248 |
| 4,372,783 | 2/1983 | Kato | 428/567 X |

*Primary Examiner*—Brooks H. Hunt
*Assistant Examiner*—Matthew A. Thexion
*Attorney, Agent, or Firm*—Wenderoth, Lind & Ponack

[57] ABSTRACT

This invention provides a vacuum type breaker contact material prepared by infiltrating copper into a sintered tungsten matrix, wherein elementary particle size and the growth of the particle size by heat processing are controlled in such a manner that the ratio of the largest value/the smallest value of tungsten particle size becomes not more than 10, and that the maximum value of tungsten particle size is not larger than 2 μm and the minimum value of tungsten particle size is not smaller than 0.3 μm.

1 Claim, 4 Drawing Figures

VACUUM TYPE BREAKER CONTACT MATERIAL OF COPPER INFILTRATED TUNGSTEN

This application is a continuation of application Ser. No. 98,198, filed Nov. 27, 1979 (now abandoned).

BACKGROUND OF THE INVENTION

This invention relates to a vacuum type breaker contact material.

Generally, necessary properties required by a vacuum type circuit breaker contact are as follows:

(1) high dielectric strength; (2) high-electric current can be interrupted; (3) small chopping current; (4) small welding force (welding tendency); (5) little waste; (6) low contact resistance; and the like.

However, it is very difficult for the contacts used in practice to have all of the above mentioned properties. Thus, the conventionally used contacts have the most essential properties, but some other properties are sacrificed.

For example, the conventionally used vacuum type breaker contact (hereinafter referred to as Cu-W contact) made of a sintered tungsten matrix (hereinafter referred to as W) impregnated with copper (hereinafter referred to as Cu) has a satisfactory dielectric strength, but chopping current is large and welding tendency is high.

The term, "welding tendency (or welding force)" used herein means the phenomenon of melting and welding between two contacts caused by Joule's heat determined by the value of electric current applied between the two contacts and the value of contact resistance therebetween when the two contacts are brought into contact with each other. This welding force is expressed by a force (kg) necessary to detach the two contacts.

The conventional Cu-W contact was prepared by infiltrating Cu into a W matrix sintered to a predetermined density by the powder metallurgy technique. The amount of Cu infiltrated is determined by the density of the sintered W matrix.

Generally, a notable metallurgical reaction is not recognized between W and Cu in a sintered W matrix infiltrated with Cu. That is, the performance of the Cu-W contact depends on the individual physical properties of W and Cu in the texture of the W skeleton in which Cu is dispersed. Accordingly, the performance of the Cu-W contact is greatly influenced by the particle size of W. For example, the smaller the particle size of W, the more uniform the copper dispersion, and therefore chopping current and welding force become lower.

However, the ratio of the largest value/the smallest value of tungsten particle size in the conventional contact material is more than 10, thus tungsten in the conventional contact material has various particle sizes. Also, the limitation of the size of W particles to 2 μm or less is not executed since the infiltration of Cu is harder.

SUMMARY OF THE INVENTION

An object of the present invention is to overcome the above mentioned disadvantages. Thus, the object of the present invention is to provide a highly reliable Cu-W contact material having excellent properties vis-ã-vis welding tendency and chopping current.

DESCRIPTION OF THE PREFERRED EMBODIMENT

According to the present invention, the particle size of W in a Cu-W contact is so controlled as not to grow and enlarge. Thus, the properties of the contact material are made stable and reliable by preventing the growth of the elemental particle size of W and also preventing the enlargement of the particle size of W by heat in the main heating process of the production step such as during sintering W and infiltrating Cu.

We note that the particle size of W should be classified into the elemental particle size and the particle size enlarged by the heating process. A Cu-W contact having Cu more appropriately dispersed can be obtained by effectively controlling both particle sizes.

It is clear that the infiltration of Cu becomes difficult if the elemental particle size is restricted. However, we have succeeded in the infiltration of W having a small elemental particle size, e.g. 0.3 μm–2 μm by using the vacuum infiltration technique. As can be seen from the properties shown in FIG. 1, the welding tendency and the chopping electric current are improved by controlling the elemental particle size of W to a small size, preferably to 2 μm or less. On the other hand, if the elemental particle size of W is not larger than 0.3 μm, it is difficult to infiltrate Cu.

We have discovered also that the infiltration of Cu becomes easy in the case of a W skeleton prepared by sintering W in a mixture with a predetermined amount of a supplemental material such as Cu, Ni, Co, Ta or a mixture thereof.

According to this invention, the ratio of the maximum particle size/the minimum particle size of W and an absolute particle size of W can be controlled in the following manner. For example, a W skeleton is placed in a graphite crucible in such a manner as to come in contact with the crucible through Cu for infiltration, and then the Cu is melted and infiltrated by the high-frequency heating technique. In this method, the temperature of Cu is raised first, and when the temperature of Cu exceeds the melting point of 1083° C., Cu is gradually infiltrated into the W skeleton. Since the particle of W is enveloped by Cu, a local growth of W particle size can effectively be prevented even when the temperature distribution of the W skeleton is not uniform in the temperature zone of 1083° C. or higher. This is an example of a preferable procedure, but the W skeleton may be placed directly in the crucible if desired.

Figure 2:
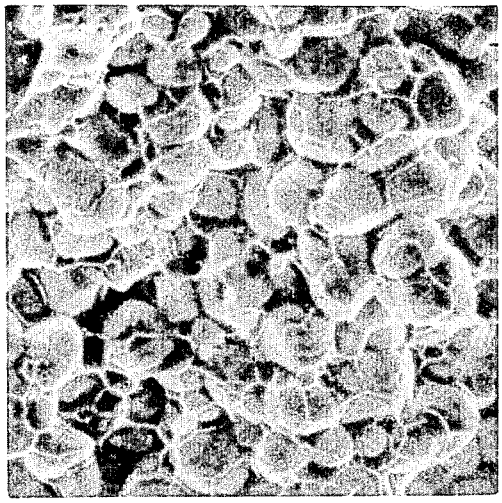
FIG. 2 is a photograph by an electronic microscope (×4200) of the structure of a Cu-W contact prepared in accordance with the present invention.
Figure 3A:
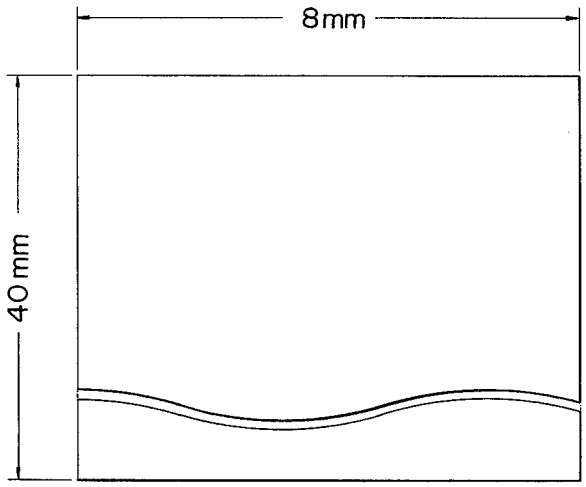
FIG. 3(*a*) shows an external form of a cylindrical contact having a diameter of 40 mm and a width of 8 mm positioned in such a manner as to correspond with FIG. 3(*b*) which shows the relation between the size of W particles and the depth of a W skeleton.
Figure 3B:
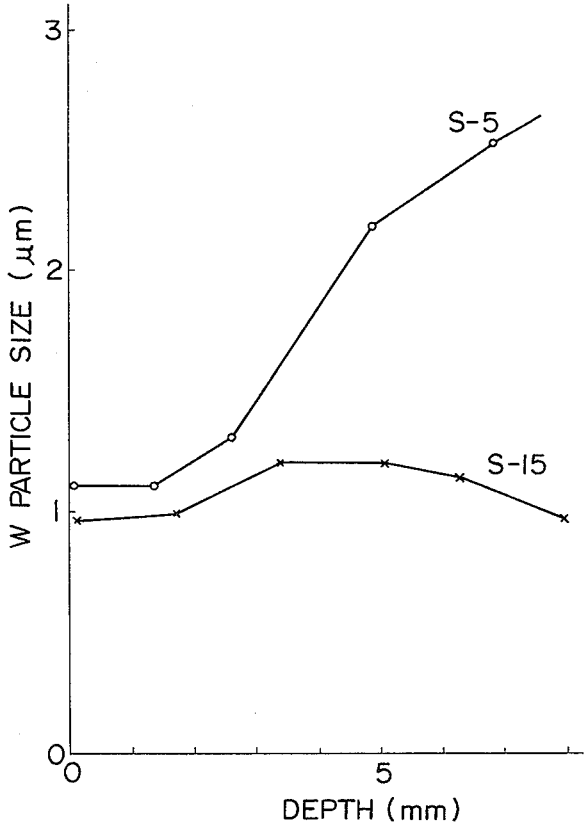

FIG. 2 shows one example of a Cu-W contact prepared in accordance with the above mentioned method of this invention. FIG. 2 is a photograph by an electronic microscope (×4200) of the texture of a cloven face of the Cu-W contact. In this photograph, a ball-like object represents W, and a strip-like black and white part represents Cu-infiltrated amount W particles. The average W particle size of this sample was 1.5 μm, and the total Cu content was 20% by weight. The particle distribution in the direction of the thickness of this Cu-W contact shows that the particle size in the central part is slightly enlarged but the particle sizes in the vicinity of both surfaces are substantially equal. In this embodiment, Cu for infiltration is placed first in a graphite crucible and a W skeleton is placed thereon and Cu for infiltration is further placed thereon. The lower and the upper Cu is infiltrated into the W skeleton when they are heated to a temperature exceeding 1083° C. by the high-frequency heating technique. The central part of the W skeleton is last to be infiltrated with Cu, and consequently the particle size of W of the central part grows slightly. This small enlargement of the W particle size in the central part does not unfavourably influence the properties of the contact material since there is no chance for this central part to come into contact with the opposing contact during its life. FIG. 3(*a*) shows an external form of a cylindrical contact having a diameter of 40 mm and a width of 8 mm positioned in such manner as to correspond with FIG. 3(*b*) which shows the relation between the particle size of W and the depth of W skeleton.

Curve S-5 in FIG. 3(*b*) shows the relation between the size of W particles and the depth of a W skeleton with regard to a Cu-W contact sample obtained by placing a W skeleton directly in a graphite crucible in such a manner as to bring W into contact with the crucible, placing Cu for infiltration on the W skeleton and then heating. In the case of this sample, the deep part of W is intensely heated and the W particles grow before Cu is infiltrated into this part. Thus, the average size of W particles enlarges in proportion to the depth. The Cu content of this sample was 10% by weight.

Curve S-15 in FIG. 3(*b*) also shows the relation between the size of W particles and the depth of a W skeleton but with regard to a Cu-W contact sample obtained by placing Cu first in a graphite crucible and then placing a W skeleton and then additional Cu. In this case, Cu is infiltrated into the W skeleton from both ends so rapidly as to prevent W particles from bonding with each other. Thus, the size of W particles in the central part also does not enlarge so much. The Cu content of this sample was 20% by weight. The latter sample is more preferable, but the former sample can also be practically used.

Thus, since the W particle size of the Cu-W contact of this invention is smaller and Cu is more uniformly dispersed in the whole of a W skeleton as compared with a conventional contact material which is not treated as in this invention, chopping current and welding tendency are reduced. Furthermore, since the particle size of W in every part is uniform, the level of the chopping current and the welding force is stable and accordingly a highly reliable contact having better performance than a conventional Cu-W contact can be obtained.

As mentioned above, the essential feature of this invention is to make the ratio of the largest value/the smallest value of tungsten particle size not more than 10 by controlling the elemental particle size of tungsten and the growth of the particle size of tungsten during heating process.

Preferably, the maximum value of tungsten particle size is limited to not larger than 2 μm and the minimum value is limited to not smaller than 0.3 μm.

Figure 1:
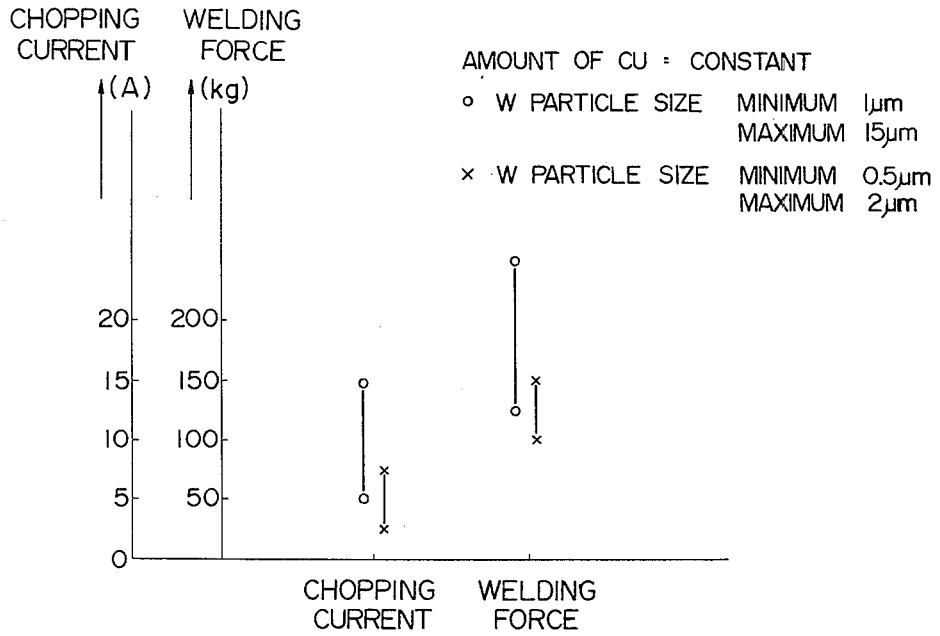
FIG. 1 shows the relation of the tungsten particle distribution of a Cu-W contact versus chopping current and welding force.

FIG. 1 shows the relation of the tungsten particle distribution of a Cu-W contact versus chopping current and welding force. FIG. 1 shows the ranges of the measured values of chopping electric current and welding force with regard to a comparative Cu-W contact wherein the largest value of W particle size is 15 μm and the smallest value is 1 μm, and a Cu-W contact of this invention wherein the largest value of W particle size is 2 μm and the smallest value is 0.5 μm. It is clear from this figure that the chopping electric current properties and the welding tendency of the Cu-W contact of this invention are much better than those of the comparative Cu-W contact.

As mentioned above, the present invention provides a highly reliable vacuum type breaker contact material having excellent performance in respect of dielectric strength, chopping electric current properties and welding tendency, and which is very effective for practical use.

I claim:

1. A vacuum type breaker contact material prepared by infiltrating copper into a sintered tungsten matrix, wherein the maximum value of tungsten particle size within the finished material is not larger than 2 μm and the minimum value of tungsten particle size within the finished material is not smaller than 0.5 μm.

* * * * *